US008186279B2

(12) United States Patent
Halliar et al.

(10) Patent No.: US 8,186,279 B2
(45) Date of Patent: May 29, 2012

(54) REMOVABLE BULKHEAD FOR A RAILCAR

(75) Inventors: William R. Halliar, Whiting, IN (US); Bruce E. Keating, Aurora, IL (US); Stuart F. Trout, Frankfort, IL (US)

(73) Assignee: TTX Co., Chicago, IL (US)

( * ) Notice: Subject to any disclaimer, the term of this patent is extended or adjusted under 35 U.S.C. 154(b) by 0 days.

(21) Appl. No.: 11/788,070

(22) Filed: Apr. 18, 2007

(65) Prior Publication Data

US 2008/0011187 A1 Jan. 17, 2008

Related U.S. Application Data

(60) Provisional application No. 60/796,172, filed on Apr. 28, 2006.

(51) Int. Cl.
*B61D 25/00* (2006.01)

(52) U.S. Cl. ..... 105/396; 410/94; 410/121

(58) Field of Classification Search ..... 410/94, 410/121, 129, 153; 105/396
See application file for complete search history.

(56) References Cited

U.S. PATENT DOCUMENTS

| | | | | |
|---|---|---|---|---|
| 1,401,419 | A * | 12/1921 | McNally | 410/129 |
| 3,089,437 | A * | 5/1963 | Hendricker | 105/411 |
| 3,464,368 | A * | 9/1969 | Cordani | 410/94 |
| 3,779,174 | A * | 12/1973 | Doyle et al. | 410/121 |
| 4,091,742 | A * | 5/1978 | Cordani | 410/94 |
| 4,193,736 | A * | 3/1980 | Thomaswick | 414/812 |
| 4,498,824 | A * | 2/1985 | Kinkle | 410/121 |
| 4,648,764 | A * | 3/1987 | Pavlick | 410/77 |
| 4,799,840 | A * | 1/1989 | Van Gompel et al. | 410/42 |
| 5,076,745 | A * | 12/1991 | Klein | 410/94 |
| 5,137,405 | A * | 8/1992 | Klein | 410/94 |
| 5,378,047 | A * | 1/1995 | Merrett et al. | 298/17 R |
| 6,099,220 | A * | 8/2000 | Poth | 410/94 |
| 6,431,804 | B1 | 8/2002 | Wetzig, III | |
| 6,572,314 | B2 * | 6/2003 | French | 410/94 |
| 2008/0011187 | A1 * | 1/2008 | Halliar et al. | 105/396 |
| 2008/0166199 | A1 * | 7/2008 | Halliar | 410/94 |

* cited by examiner

*Primary Examiner* — S. Joseph Morano
*Assistant Examiner* — Jason C Smith
(74) *Attorney, Agent, or Firm* — Brinks Hofer Gilson & Lione

(57) ABSTRACT

A removable bulkhead for a railcar is provided, wherein the railcar includes a pair of spaced-apart side sills, at least one side stake pocket, and at least one end stake pocket. The removable bulkhead includes a support structure removably attachable to the railcar. The support structure of the removable bulkhead includes at least one bottom connecting mechanism, and the bottom connecting mechanism is receivable in a corresponding end stake pocket of the railcar. The removable bulkhead further includes at least one stabilizing mechanism operatively connecting the support structure to the railcar.

26 Claims, 13 Drawing Sheets

REMOVABLE BULKHEAD FOR A RAILCAR

RELATED APPLICATIONS

This application claims the benefit under 35 U.S.C. §119 (e) of U.S. Provisional Application No. 60/796,172, filed Apr. 28, 2006, and titled "Removable Bulkhead for a Railcar," which is incorporated herein by specific reference.

FIELD OF THE INVENTION

This invention relates to bulkheads on railcars, and more particularly to a removable bulkhead for a railcar.

BACKGROUND

Bulkheads for use on railcars, and more particularly flatcars, are generally known by those skilled in the art. Bulkheads are typically attached to railcars when transporting floating loads. Floating loads are generally not restrained in the longitudinal direction, relative to the railcar and rails, by a stop. According to open top loading rules (OTLR) relating to railcars set forth by the American Association of Railroads, a bulkhead is required when transporting a floating load. The bulkhead acts to maintain the floating load in a secured manner in case the load slides during impact of the railcar or shifting of the load in the longitudinal direction relative to the railcar during transport.

Bulkheads are typically attached to a railcar by securing a large member that extends upwardly from the railcar floor in a cantilevered manner. The bulkhead can be attached to the railcar by nuts-and-bolts, welding, any combination thereof, or any other attachment mechanism known to those skilled in the art. Bulkheads are generally attached to railcars in a substantially fixed, or permanently-attached, manner. However, when transporting loads other than floating loads in which a bulkhead is not necessary, the bulkhead may be burdensome to the loading and unloading of the railcar. The presence of bulkheads on load configurations that do not require bulkheads unnaturally limits the loading capacity of the railcar. The weight of the unnecessary bulkhead displaces usable load for transport. Removal of the bulkhead from railcars is very labor-intensive, costly, and may require structural changes to the railcar itself.

BRIEF SUMMARY

According to a first aspect of the present invention, a removable bulkhead for a railcar is provided. The railcar to which the removable bulkhead is removably attached includes a pair of spaced-apart side sills, at least one side stake pocket, and at least one end stake pocket. The removable bulkhead includes a support structure that is removably attachable to the railcar, wherein the support structure includes at least one bottom connecting mechanism and each bottom connecting mechanism is receivable in a corresponding end stake pocket of the railcar. The removable bulkhead further includes at least one stabilizing mechanism operatively connecting the support structure to the railcar.

According to another aspect of the present invention, a method for attaching a removable bulkhead to a railcar is provided. The method includes providing a railcar, wherein the railcar includes a pair of spaced-apart side sills, at least one side stake pocket, and at least one end stake pocket. The method further includes attaching the removable bulkhead to the railcar in a removable manner. The removable bulkhead includes a support structure being receivable in an end stake pocket and at least one stabilizing mechanism operatively connected to one of the side sills of the railcar Advantages of the present invention will become more apparent to those skilled in the art from the following description of the preferred embodiments of the invention which have been shown and described by way of illustration. As will be realized, the invention is capable of other and different embodiments, and its details are capable of modification in various respects. Accordingly, the drawings and description are to be regarded as illustrative in nature and not as restrictive.

DETAILED DESCRIPTION OF THE DRAWINGS AND THE PRESENTLY PREFERRED EMBODIMENTS

Figure 1:
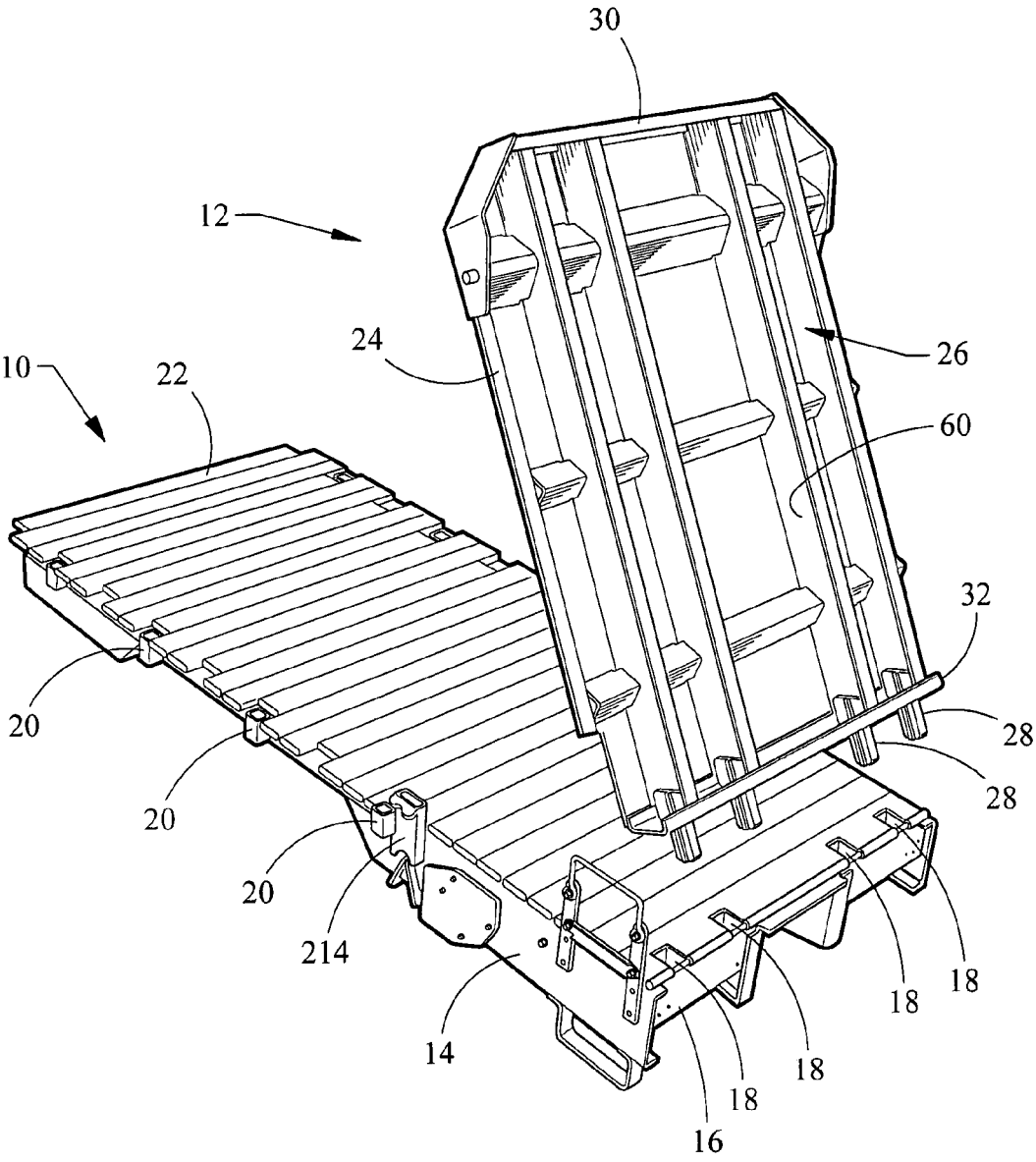
FIG. 1 is one embodiment of a structural support of a removable bulkhead and a flatbed railcar.

Referring to FIG. 1, one embodiment of a railcar 10 and a removable bulkhead 12 are shown. The railcar 10 is illustrated as a conventional flat-deck railcar having a pair of substantially parallel, spaced-apart side sills 14, an end sill 16 extending between the ends of the side sills 14, at least one end stake pocket 18, and at least one side stake pocket 20. The deck 22 of the railcar 10 is shown as a plurality of wood pieces arranged in an abutting manner, but the deck 22 can also be made of sheet steel, nailable steel, or any other material sufficient to support the loads to be carried by the railcar 10.

Bulkheads are generally attached to a flatbed railcars 10 to provide an apparatus for preventing loads from sliding or falling off the ends of the railcar due to the shifting of the load during transport, particularly in the longitudinal direction that is substantially parallel to the side sills of the railcar as well as the rails of the track on which the railcar is disposed. Because of the forces exerted on the loads in the longitudinal direction during acceleration or deceleration of the railcar, particularly rapid accelerations caused by an impact, a bulkhead must be designed with withstand the impact or the force applied to the bulkhead by the load thereto if the load shifts during transport. Typically, one bulkhead is attached to each end of the railcar so as to interrupt the movement of the shifting load at both ends of the railcar, thereby preventing the load from shifting in either the fore and aft directions beyond the ends of the railcar.

Figure 2:
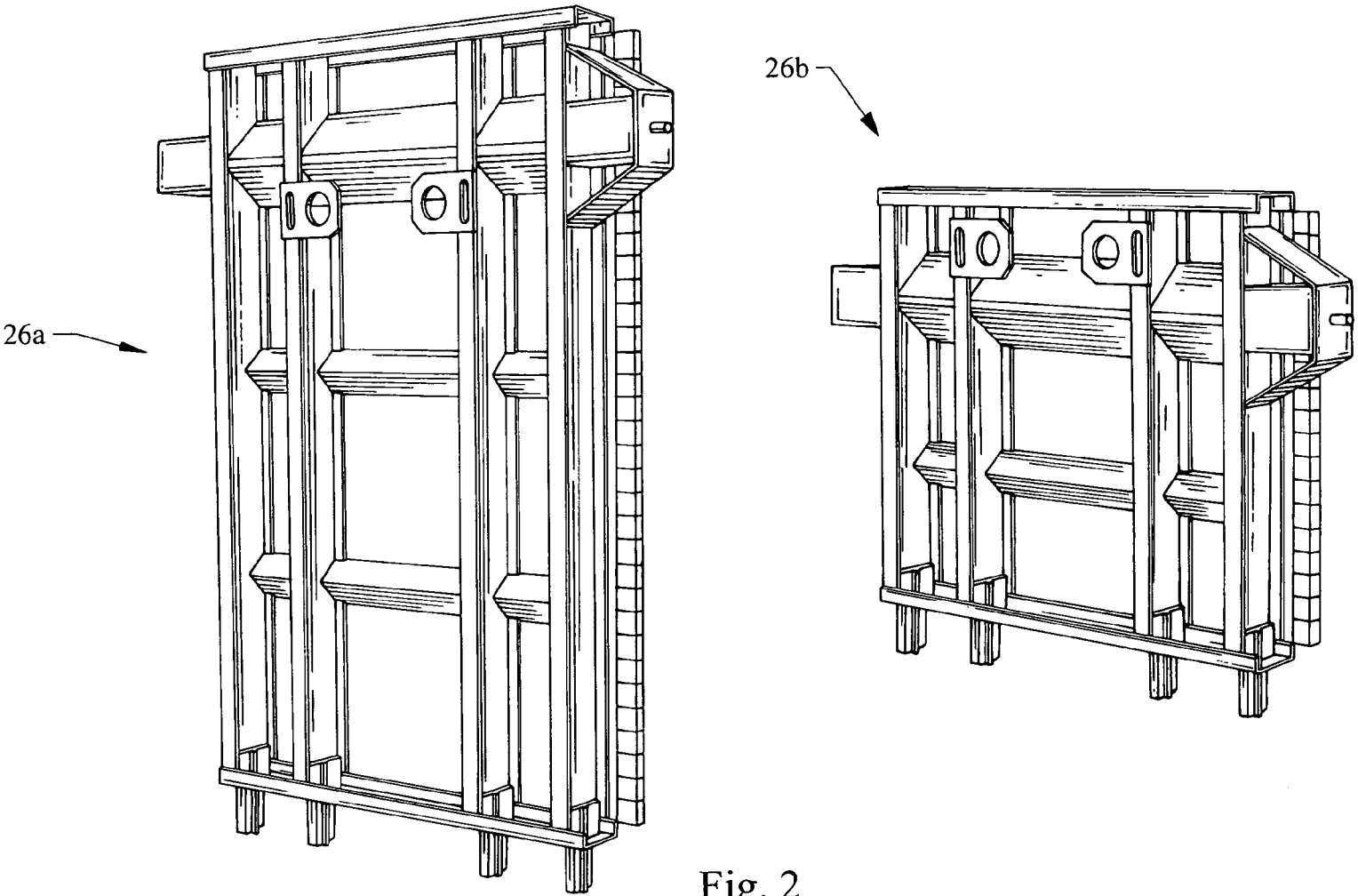
FIG. 2 is two embodiments of a structural support of a removable bulkhead.

As shown in FIG. 2, two embodiments of the support structure 26*a*, 26*b* of a removable bulkhead 12 are shown. While the overall structure of each of these two embodiments is substantially similar, the height of the support structure 26*a*, 26*b* is different. Railcars 10 are used to transport various types of loads, and different sizes and heights of removable bulkheads can be used when transporting various types of loads. For example, when transporting coiled rods of steel the height of the removable bulkhead does not have to be as high as when a load of sheet rock or logs is being transported. The description below provides the structural elements of both embodiments of the support structure 26*a*, 26*b* in reference to an exemplary embodiment of a support structure 26. One skilled in the art would understand the different sizes and shapes of the structural members as they are used on various embodiments of a removable bulkhead.

Figure 3:
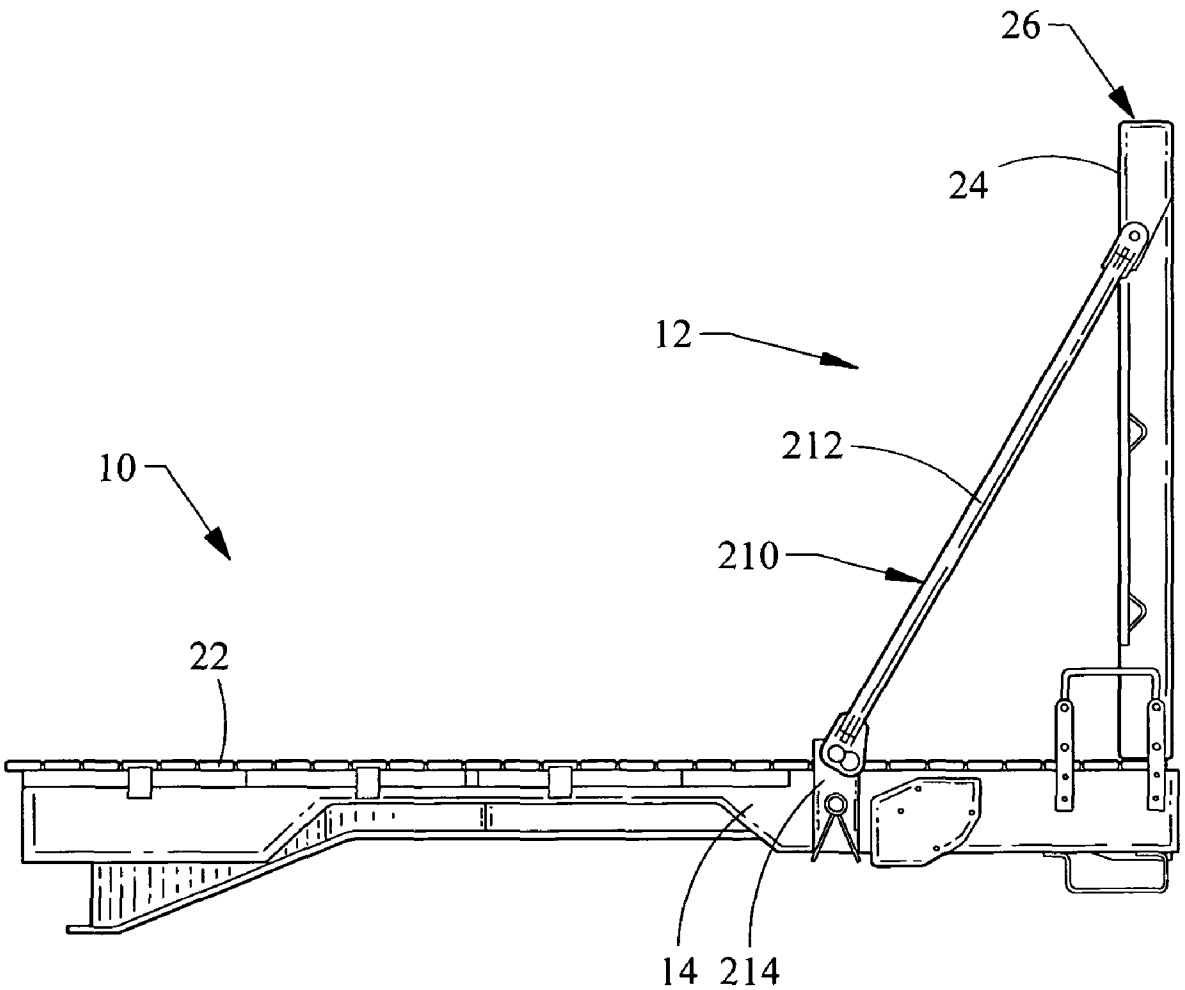
FIG. 3 is a removable bulkhead in a secured position relative to a railcar.

The support structure 26 of a removable bulkhead 12 is shown in FIG. 1 in a spaced-apart, unconnected position, and FIG. 3 illustrates the removable bulkhead 12 in an attached, secured position relative to a railcar 10. The bulkhead 12 is removable from the railcar 10 in order to allow the railcar 10 to be a more universal railcar that can be used in a variety of different operations and capable of carrying a variety of different loads. For example, a bulkhead that is permanently, or semi-permanently, attached to the railcar does not allow for the transport of some loads such as pipes or tubes that are longer than length of the deck 22. A permanently attached bulkhead may also interfere with the loading or unloading of various loads, whereas the removable bulkhead 12 is capable of being removed, thereby allowing the modification of the railcar 10 for use in more applications than a railcar having a permanently attached bulkhead.

Figure 4:
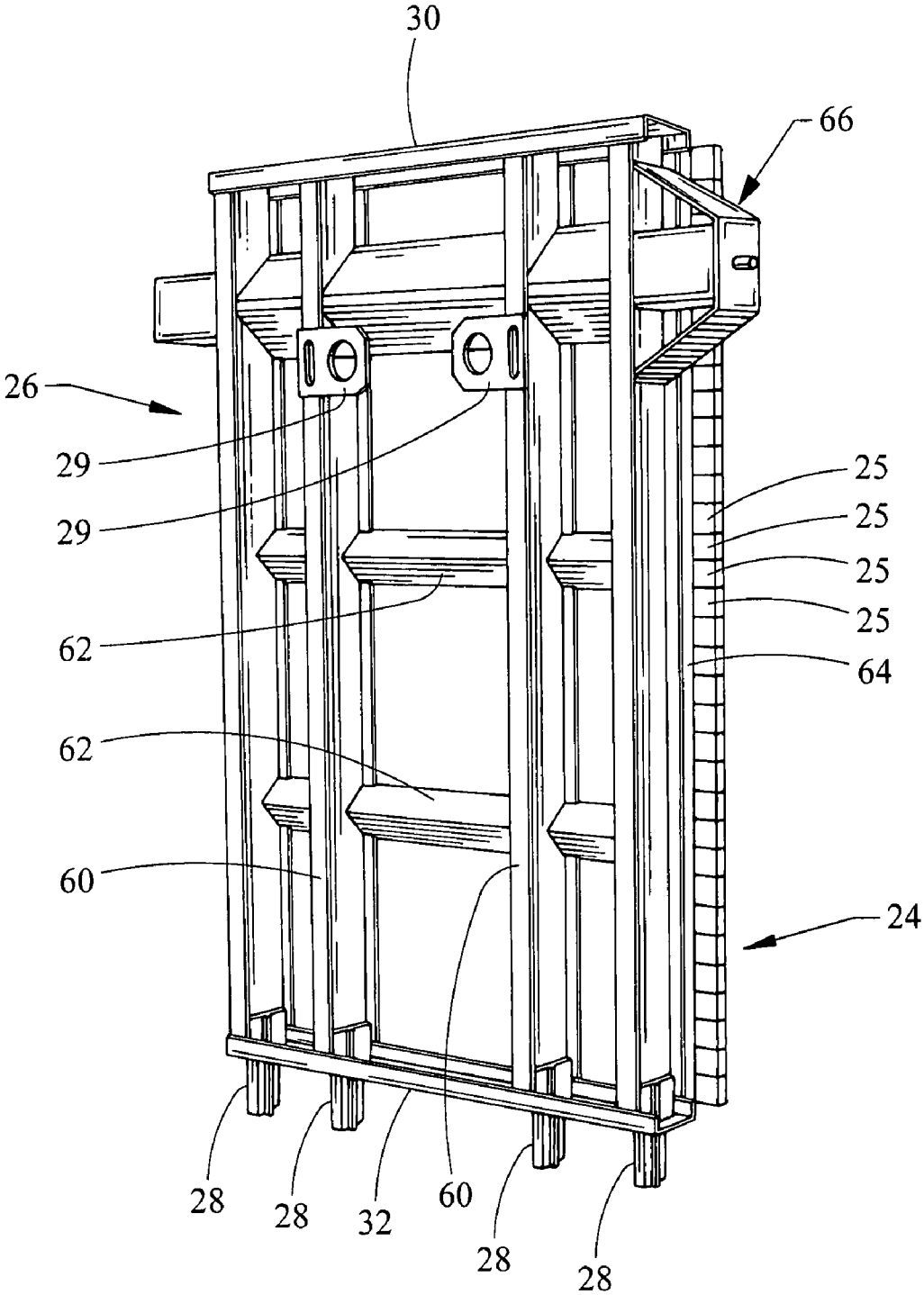
FIG. 4 is a rear view of a structural support of a removable bulkhead.
Figure 5:
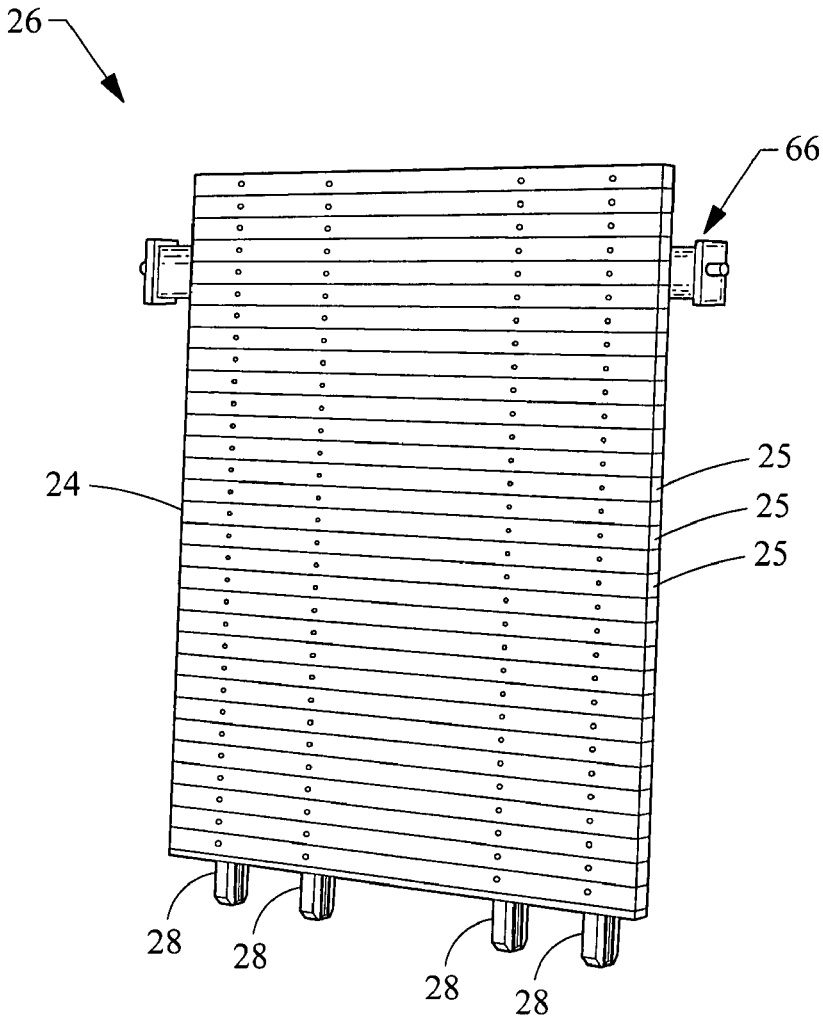
FIG. 5 is a front view of the structural support of FIG. 4.

As shown in FIG. 3, a removable bulkhead 12 includes a support structure 26 and a stabilizing mechanism 210. The support structure 26 of the removable bulkhead 12, as illustrated in FIGS. 3-5, includes a stop surface 24, a top chord 30, a bottom chord 32, a face plate 64, at least one bottom connecting mechanism 28, at least one side connecting mechanism 66, at least one vertical brace 60, at least one horizontal brace 62, and a pair of lifting lugs 29. When the removable bulkhead 12 is attached to a railcar 10, the support structure 26 is oriented such that the stop surface 24 is directed toward the loading area of deck 22 of the railcar 10. The stop surface 24 is adapted to receive or contact the load being carried by the railcar 10 if the load were to shift during transport. In one embodiment, the stop surface 24 is formed of a plurality of wood planks 25 oriented in a substantially parallel, abutting relationship relative to the adjacent plank 25. The planks 25 are aligned such that the longitudinal length of each plank 25 is oriented in a transverse manner relative to the side sills 14 of the railcar 10. The stop surface 24 may also be formed of sheet aluminum, sheet steel, or any other material sufficient to absorb the impact or forces exerted thereupon by the load being transported if the load shifts. Additionally, the stop surface 24 can be formed as a single member or a plurality of members aligned in an abutting or a spaced-apart manner. The stop surface 24 is operatively attached to the support structure 26 by a plurality of bolts, but the stop surface 24 may also be attached to the support structure 26 by welding, rivets or any other attachment mechanism sufficient to secure the stop surface 24 to the support structure 26. The stop surface 24 may be directly attached to the support structure 26, or an intermediate or buffer member may be disposed between the stop surface 24 and the support structure 26.

The top chord 30 of the support structure 26, as illustrated in FIG. 4, is a generally U-shaped member in which the flanges of the top chord 30 are directed downwardly toward the bottom chord 32. The longitudinal length of the top chord 30 is oriented in a substantially horizontal manner. The top chord 30 is formed of steel, but can be made of any material sufficient to reinforce the stop surface 24.

Figure 6:
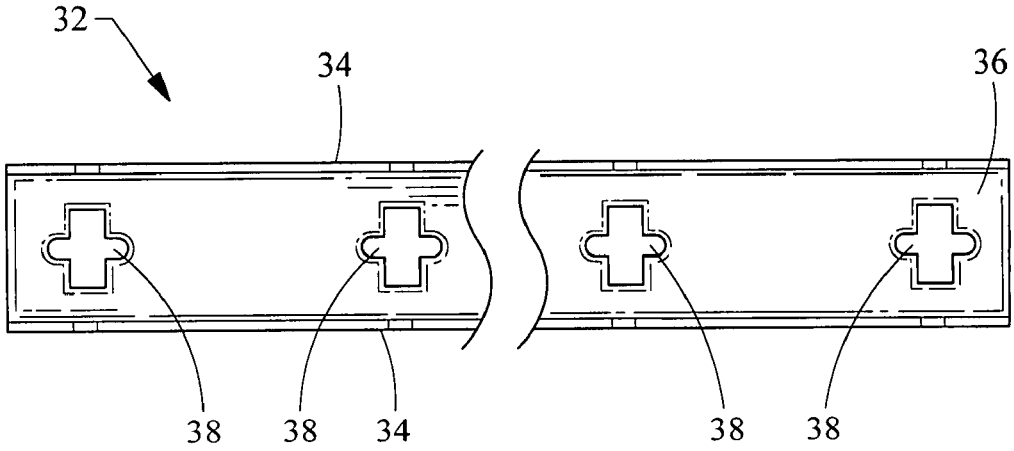
FIG. 6 is a top view of one embodiment of a bottom chord.

The bottom chord 32 of the support structure 26, as shown in FIGS. 4 and 6, is a generally U-shaped member having a pair of opposing, substantially parallel flanges 34 connected by a web 36. The opposing flanges 34 of the bottom chord 32 are directed upwardly toward the top chord 30, wherein the top chord 30 and bottom chord 32 are directed toward each other in an opposing manner. The bottom chord 32 includes at least one aperture 38 formed through the web 36. Each aperture 38 is shaped to receive a bottom connecting mechanism 28 (FIG. 4) that is attached to the support structure 26 of the removable bulkhead 12. Each aperture 38 is sized slightly larger than the shape of the bottom connecting mechanism 28 in order to allow any precipitation that may accumulate within the bottom chord 32 to be relieved in order to prevent excessive rusting of the bottom chord 32.

The face plate 64 is a vertically oriented piece of sheet material that is disposed between the stop surface 24 and the vertical braces 60, as illustrated in FIG. 4. The face plate 64 extends between, and is attached to, both the top and bottom chords 30, 32. The face plate 64 is also attached to the stop surface 24, thereby providing support thereto. The face plate 64 is a structural member that may provide a buffer between the stop surface 24 and the vertical and horizontal braces 60, 62 of the support structure 26. The face plate 64 is formed of sheet steel, but can be made of any other material sufficient to withstand the forces exerted upon the removable bulkhead 12 by a load shifting during transport.

Figure 7A:
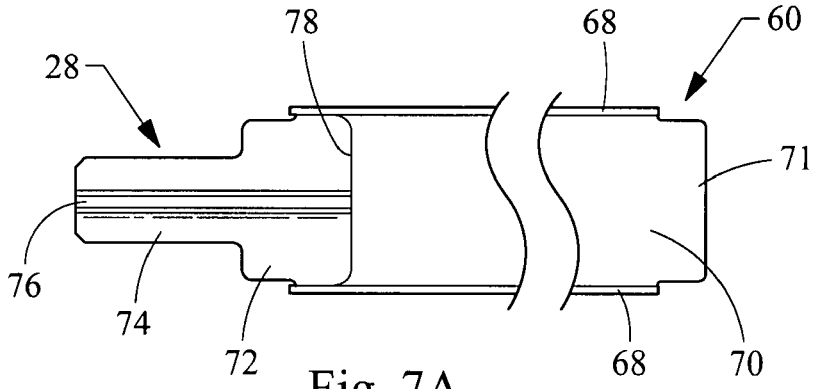
FIG. 7*a* is a side view of a bottom connecting mechanism attached to a vertical brace.
Figure 7B:
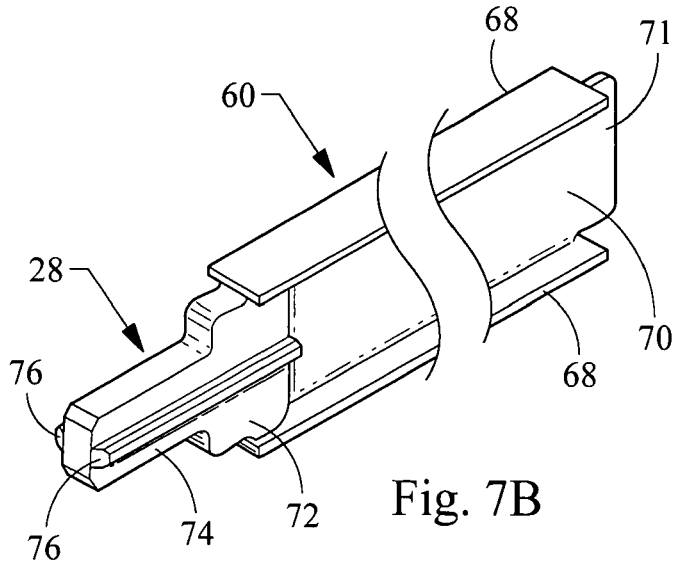
FIG. 7*b* is a perspective view of the bottom connecting mechanism and vertical brace of FIG. 7*a;*

As shown in FIG. 4, four spaced-apart vertical braces 60 extend between the top chord 30 and bottom chord 32, but any number of vertical braces 60 can be used for the support structure 26. Each vertical brace 60 is formed of an I-beam having a pair of substantially parallel, spaced-apart flanges 68 connected by a web 70, as shown in FIGS. 7A-7B. At one distal end of each vertical brace 60, the web 70 extends beyond the flanges 68 to form an extension portion 71. The extension portion 71 is adapted to be received within the U-shaped portion of the top chord 30, and the shape and size of the extension portion 71 is configured to fit within the top chord 30 such that the surfaces of the extension portion 71 are in an abutting relationship with the inner surface of the top chord 30. Each vertical brace 60 is attached to the top chord 30 by welding, but any other attachment mechanism between each vertical brace 60 and the top chord 60 sufficient to withstand the forces exerted upon the removable bulkhead 12 can be used. The vertical brace 60 is oriented such that an outer surface of one flange 68 is in a substantially parallel, abutting relationship with the face plate 64. Each vertical brace 60 is attached to the surface of the face plate 64 opposite the surface to which the stop surface 24 is attached.

Each vertical brace 60 includes a bottom connecting mechanism 28 attached thereto, as illustrated in FIGS. 4 and 7A-7B. In one embodiment, the bottom connecting mechanism 28 includes a base 72, an elongated portion 74 extending therefrom, and at least one rib 76. The base 72 is formed as a substantially rectangular portion having a top surface 78. The elongated portion 74 extends from the base 72 in the direction opposite the top surface 78. In one embodiment, the base 72 and the elongated portion 74 are formed as a single member. In an alternative embodiment, the base 72 and elongated portion 74 are formed as separate members that are fixedly connected to each other. An elongated rib 76 may be disposed on opposing surfaces of the bottom connecting mechanism 28 in a manner substantially parallel to the elongated direction of the elongated portion 74 of the bottom connecting mechanism 28. The rib 76 may extend from one distal end of the bottom connecting mechanism 28 adjacent to the top surface 78 to the opposing distal end of the bottom connecting mechanism 28. In another embodiment (not shown), the rib 76 may extend only a portion of the length of the elongated portion 74 of the bottom connecting mechanism 28. In one embodiment, the rib is attached to the base 72 and the elongated portion 74 by way of a weld, but any other attachment means can be used. In an alternative embodiment, the rib 76 is integrally formed with the base 72 and the elongated portion 74 as a single member such as a casting or the like.

Each vertical brace 60 has a bottom connecting mechanism 28 attached to the end opposite the connection between the vertical brace 60 with the top chord 30, as shown in FIGS. 7A-7B. The portion of the web 70 of the vertical brace 60 opposite the extension portion 71 is cut out in a shape substantially similar to the top surface 78 of the bottom connecting mechanism 28. The bottom connecting mechanism 28 is disposed within the cut out portion of the web 70 in an abutting manner such that the top surface 78 contacts the web 70 and the opposing flanges 68 of the vertical brace 60. The bottom connecting mechanism 28 may be welded to the vertical brace 60, or any other attachment means sufficient to withstand the loads applied to the removable bulkhead 12 can be used. The vertical brace 60 is attached to the bottom chord 32 such that the opposing flanges 68 of the vertical brace 60 are disposed adjacent to opposing flanges 34 of the bottom chord 32 and the elongated portion 74 and the ribs 76 of the bottom connecting mechanism 28 extend through the aperture 38 formed in the bottom chord 32. The vertical brace 60 may be attached to the bottom chord 32 by way of a weld so as to provide a secure connection between the vertical brace 60 and the bottom chord 32.

Figure 8:
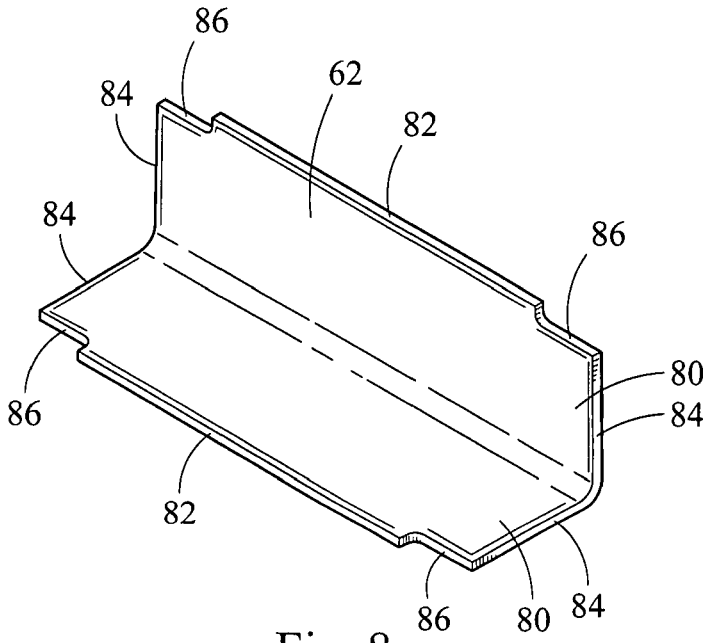
FIG. 8 is a perspective view of one embodiment of a horizontal brace.

In one embodiment, as shown in FIG. 4, a plurality of horizontal braces 62 are disposed between each of the vertical braces 60, wherein the plurality of horizontal braces are aligned to form a single member extending between the outwardmost vertical braces. Each horizontal brace 62 is an elongated member having a pair of legs 80, wherein each leg is formed at an angle relative to the other leg, as shown in FIGS. 8A-8B. In one embodiment, the horizontal brace 62 is formed from a stamped piece of metal, wherein a radius of curvature is formed between the pair of legs 80. In an alternative embodiment, the horizontal brace 62 is formed by two elongated pieces of metal attached to each other by a weld or other attachment mechanism. While the horizontal brace 62 is shown as being a two-legged angled member, the horizontal brace 62 may also have a square cross-section, rectangular cross-section, or any other cross-section sufficient to provide support to the stop surface 24 and between the vertical braces 60. The longitudinal edges 82 of each leg 80 are disposed in an abutting relationship with the face plate 64, and the end edges 84 of each leg 80 are disposed in an abutting relationship with the web 70 of the vertical braces 60 between which each horizontal brace 62 extends. Each longitudinal edge 82 includes a cut-out 86 at each end thereof. The cut-outs 86 allows the end edges 84 to contact the web 70 of a vertical brace 60 and each cut-out 86 is adapted to receive a flange 68 of the vertical brace 60. Each horizontal brace 62 is attached to the face plate 64 and adjacent vertical braces 60 by welding, but any other attachment means sufficient to secure the horizontal brace to the face plate and vertical braces can be used. The number of horizontal members formed by the alignment of a plurality of horizontal braces 62 can vary, but the support structure 26 should include at least one horizontal load path formed by horizontal braces 62, wherein the horizontal braces 62 may extend between the pair of side connecting mechanisms 66.

As shown in FIG. 4, three horizontal braces 62 are aligned along their longitudinal axis between each of the four single-piece vertical braces 60. In an alternative embodiment (not shown), each horizontal brace 62 is formed as single-piece members and vertical braces 60 are disposed between adjacent horizontal braces 62.

Figure 9:
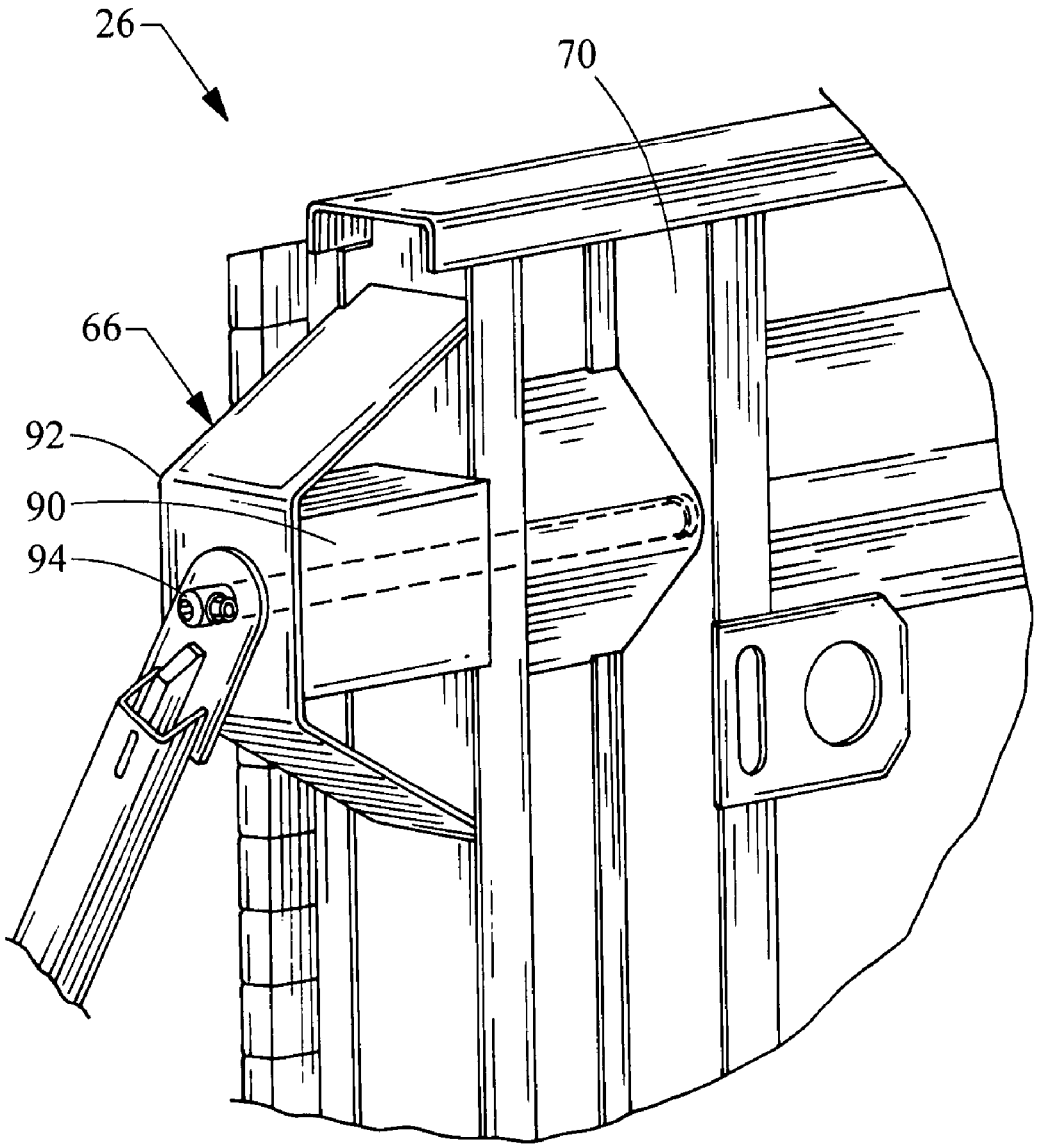
FIG. 9 is a magnified view of a stabilizing mechanism attached to a side connecting mechanism.
Figure 10:
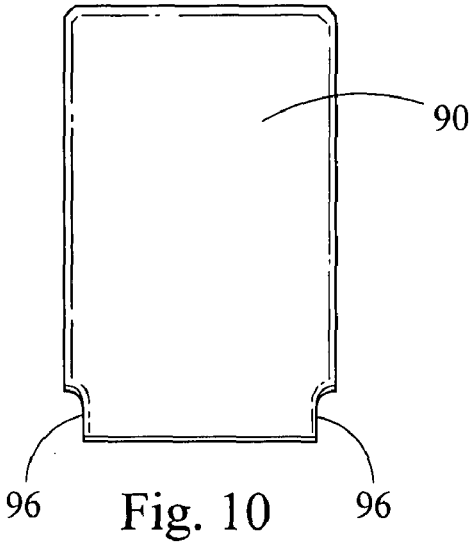
FIG. 10 is a side view of a reinforcement tube.

A side connecting mechanism 66 extends laterally outward from both sides the support structure 26 in opposing directions, as illustrated in FIGS. 4 and 9. Each side connecting mechanism 66 is operatively connected to a vertical brace 60, and each side connecting mechanism 66 is preferably disposed adjacent to the upper portion of the vertical brace 60 opposite the bottom connecting mechanisms 28. Each side connecting mechanism 66 includes a reinforcement tube 90, a reinforcement plate 92, and a collar pin 94 that extends through the reinforcement tube 90 and the reinforcement plate 92, as shown in FIG. 9. The reinforcement tube 90 is an elongated, hollow tube having a substantially square cross-section, but the cross-section of the reinforcement tube 90 can be any shape sufficient to withstand the stresses applied thereto from the shifting load. The reinforcement tube 90 includes a cut-out portion 96 at the ends of opposing side surfaces. The cut-out portions 96 allows the reinforcement tube 90 to be disposed in an abutting relationship with the opposing flanges 68 and the web 70 of the vertical brace 60. A reinforcement tube 90 is preferably welded to each outer vertical brace 60 such that the reinforcement tube 90 extends laterally outward from the vertical brace 60 to which it is attached.

Figure 11A:
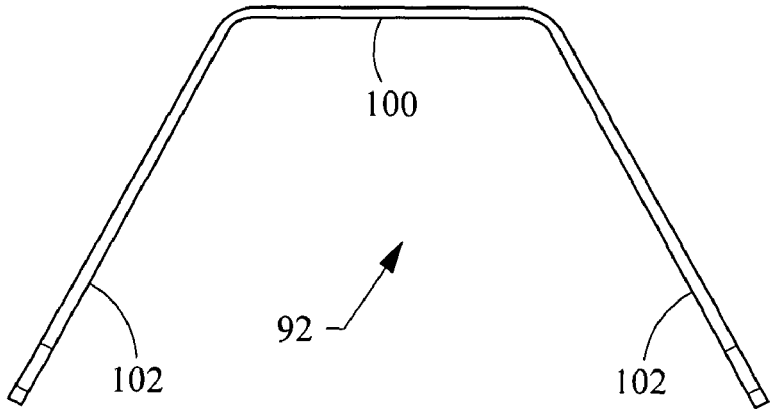
FIG. 11*a* is a side view of a reinforcement plate.
Figure 11B:
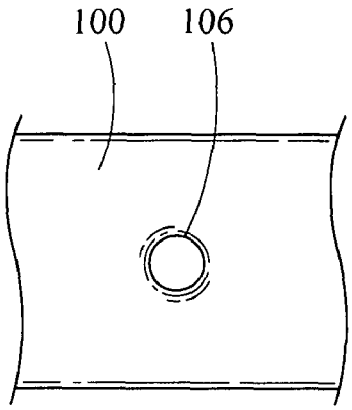
FIG. 11*b* is a top view of the reinforcement plate of FIG. 11*a;*
Figure 11C:
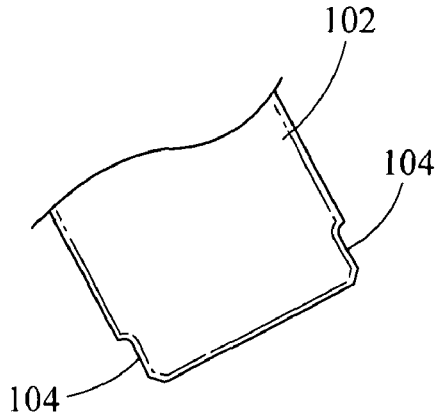
FIG. 11*c* is an end view of the reinforcement plate of FIG. 11*a;*

The reinforcement plate 92 of the side connecting mechanism 66 includes a top portion 100 and a pair of legs 102 extending in opposite directions at an angle from the top portion 100, as shown in FIGS. 11A-11C. In one embodiment, the reinforcement plate 92 is formed as a single member, but the reinforcement plate 92 may also be formed such that the legs 102 are attached to the top portion 100 by way of a weld. The reinforcement plate 92 is disposed adjacent to the end of the reinforcement tube 90 such that the inwardly-directed surface of the top portion 100 of the reinforcement plate 92 is in an abutting relationship with the end of the reinforcement tube 90 opposite the cut-out portions 96, as shown in FIG. 9. The top portion 100 is preferably welded to the end of the reinforcement tube 90, and both of the legs 102 of the reinforcement plate 92 are directed toward the vertical brace 60 to which the reinforcement tube 90 is connected. Each opposing lateral edge of each leg 102 includes a cut-out portion 104 at the end opposite the end of the leg 102 adjacent to the top portion 100. The cut-out portion 104 of the legs 102 of the reinforcement plate 92 form a surface that is adapted to be in an abutting relationship with the opposing flanges 68 and the web 70 of the vertical brace 60 to which the reinforcement tube 90 is attached. The ends of the legs 102 having the cut-out portions 104 located abutting the vertical brace 60 are welded to the vertical brace 60 in order to provide a secure connection between the reinforcement plate 92, reinforcement tube 90, and the vertical brace 60 to which the side connecting mechanism 66 is attached.

The top portion 100 of the reinforcement plate 92 includes an aperture 106 formed therethrough, as shown in FIG. 11B. The aperture 106 is adapted to receive a collar pin 94, as illustrated in FIG. 9. In one embodiment, the collar pin 94 extends the entire width of the support structure 26 in addition to extending outward from both side connecting mechanisms 66, wherein the collar pin 94 is connected to each side connecting mechanism 66 as well as each vertical brace 60 through which the collar pin 94 passes. In another embodiment, each side connecting mechanism 66 includes a collar pin 94 having one distal end connected in a substantially rigid manner to the web 70 of the vertical brace 60 to which the side connecting mechanism 66 is attached. The collar pin 94 extends from the web 70 of the vertical brace through, and laterally beyond, the hollow portion of the reinforcement tube 90 as well as through the aperture 106 formed in the top portion 100 of the reinforcement plate 92. The distal end of the collar pin 94 opposite the end of the collar pin 94 connected to the web 70 of a vertical brace 60 includes a hole formed therethrough in a direction transverse to the longitudinal axis of the collar pin 94, whereby the collar pin 94 of the side connecting mechanism 66 can be operatively connected to the railcar 10 by way of a stabilizing mechanism 210.

As shown in FIG. 4, the lifting lugs 29 are attached to the support structure 26 in order to allow the support structure 26 to be easily lifted away from the railcar 10 or disposed thereon.

Figure 12:
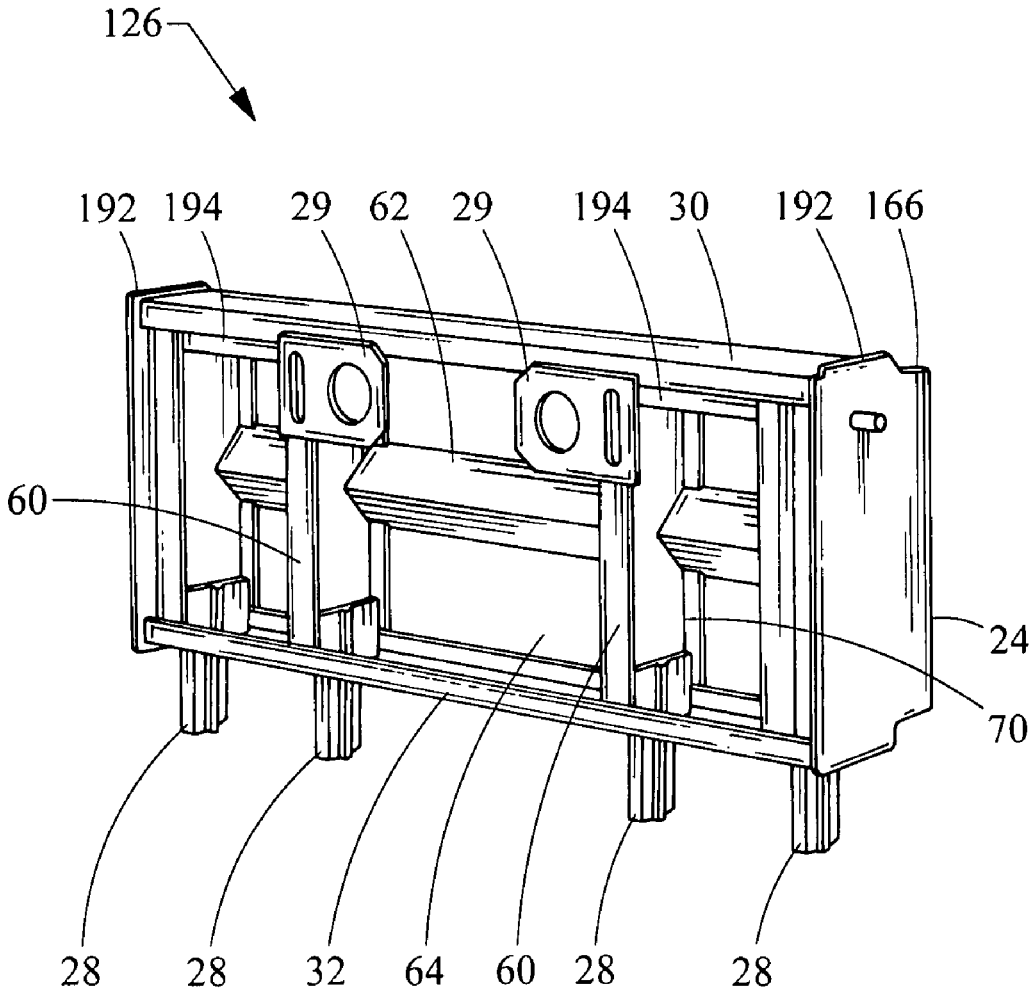
FIG. 12 is a second embodiment of a structural support of a removable bulkhead.

An alternative embodiment of a support structure 126 is shown in FIG. 12. The support structure 126 is shorter than the support structures 26*a*, 26*b* illustrated in FIG. 2. The shorter support structure 26 may be used for short, heavy loads such as stacked sheet steel or the like. Because the weight and height of certain materials being transported, a low-height support structure 126 may be used instead of a taller support structure 26*a*, 26*b*. One skilled in the art would understand that the thickness or strength of the materials and members used in the low-height support structure 126 may be greater than similar members used for the support structures 26*a*, 26*b* having a taller height in order to be capable of reinforcing a heavier load with a shorter height. The structural elements that are substantially similar between the support structure 126 shown in FIG. 12 and the support structure 26 shown in FIGS. 1-8 are described with the same reference numbers.

The support structure 126, as shown in FIG. 12, includes a stop surface 24, a top chord 30, a bottom chord 32, at least one vertical brace 60, at least one horizontal brace 62, a face plate 64, at least one bottom connecting mechanism 28, at least one side connecting mechanism 166, and a pair of lifting lugs 29. The side connecting mechanism 166 extends laterally outward from both sides the support structure 26 in opposing directions, as illustrated in FIG. 12. Each side connecting mechanism 166 includes a reinforcement plate 192, and a pin 194 that extends through the reinforcement plate 192 and at least one vertical brace 160. The reinforcement plate 192 extends between the top chord 30 and the bottom chord 32 and is attached at the distal end of both chords 30, 32. The distal end of the collar pin 194 opposite the end of the collar pin 194 connected to the vertical brace 60 includes a hole formed therethrough in a direction transverse to the longitudinal axis of the collar pin 194. In an alternative embodiment, the collar pin 194 extends between the outwardmost disposed vertical braces 60 and extends laterally further than each of these vertical braces 60 as a single member.

Figure 13A:
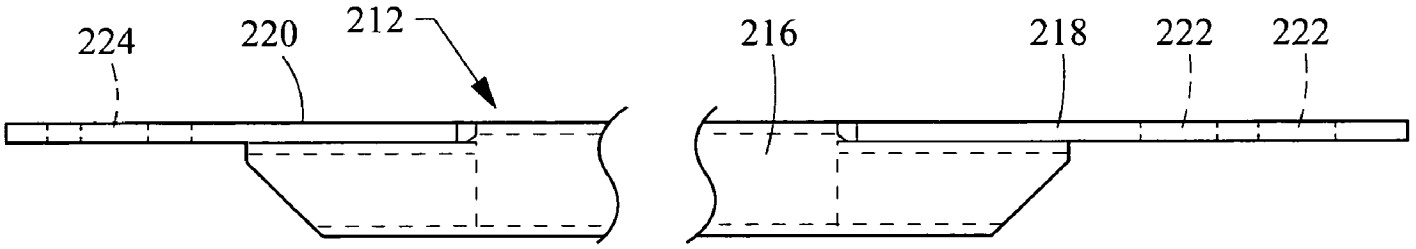
FIG. 13*a* is a side view of a side brace.
Figure 13B:
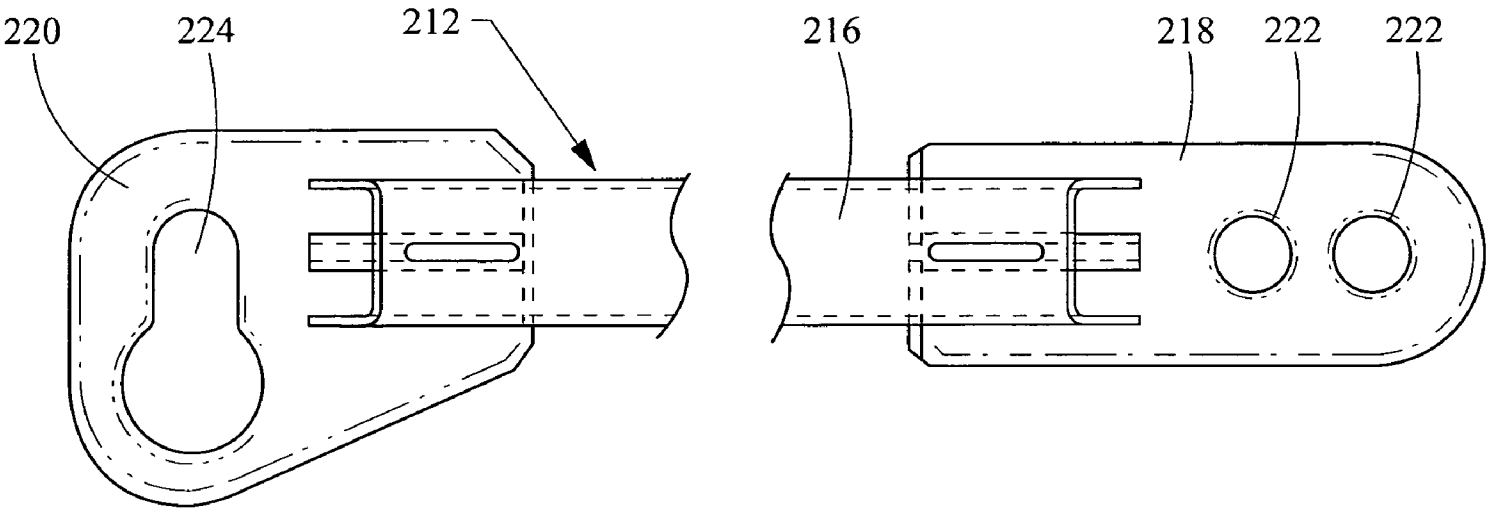
FIG. 13*b* is a top view of the side brace of FIG. 13*a;*

Referring to FIG. 3, when the support structure 26 is located in the attached, secured position, each side of the support structure 26 is attached to the opposing side sills 14 of the railcar 10 by way of the stabilizing mechanism 210. The stabilizing mechanism 210 includes a side brace 212 and a side sill bracket 214, wherein the side sill bracket 214 is attached to the side sill 14 of the railcar 10 and the side brace 212 extends between the support structure 26 and the side sill bracket 214 in order to operatively connect the sides of the support structure 26 to the railcar 10. The side sill bracket 214 can be disposed within a side stake pocket 20 or attached directly to the side sill 14, wherein additional reinforcement may be added to the inwardly directed web of the side sill 14 in order to withstand the stresses applied to the side sill 14 by the side sill bracket 214. The side brace 212 is formed of an elongated support tube 216, an upper support bracket 218, and a lower support bracket 220, as shown in FIGS. 13A-13B. One embodiment of the support tube 216 is a hollow tube having a substantially square cross-section. In an alternative embodiment, the support tube 216 is formed as a solid tube. In a further alternative embodiment, the support tube 216 has a substantially circular cross-section. The support tube 216 can have any shaped cross-section sufficient to withstand the stresses and transfer the stresses between the removable bulkhead 12, 112 and the railcar 10. Because the side brace 212 is used to secure support structures 26, 126 having different heights, the length of the support tube 216 will vary depending upon the height of the support structure 26, 126 and the distance between the side connecting mechanism 66, 166 of the support structure 26, 126 and the side sill bracket 214 to which the side brace 212 is attached. In one embodiment, the upper support bracket 218 includes a plurality of apertures 222 such that the side brace 212 can be used for support structures 26, 126 of different heights. In an alternative embodiment, the upper support bracket 218 has a single aperture 222 such that the length of the side brace 212 is adapted to a support structure having a particular height.

The upper support bracket 218 is attached at one end of the support tube 216 and the lower support bracket 220 is attached at the opposing end of the same support tube 216, as shown in FIGS. 13A-13B. The upper support bracket 218 extends from the end of the support tube 216 and includes an aperture 222 formed therethrough. The aperture 222 is adapted to receive the collar pin 94, 194 that extends laterally outward from the side connecting mechanism 66, 166 thereby forming a rotatable connection between the side brace 212 and the side connecting mechanism 66, 166 of the support structure 26, 126. The lower support bracket 220 extends from the opposing end of the support tube 216, and the lower support bracket 220 includes a keyhole aperture 224 formed therethrough. The keyhole aperture 224 is adapted to receive a connecting pin 128 extending from the side sill bracket 214, thereby operatively connecting the side brace 212 to the side sill 14 of the railcar 10.

Figure 14B:
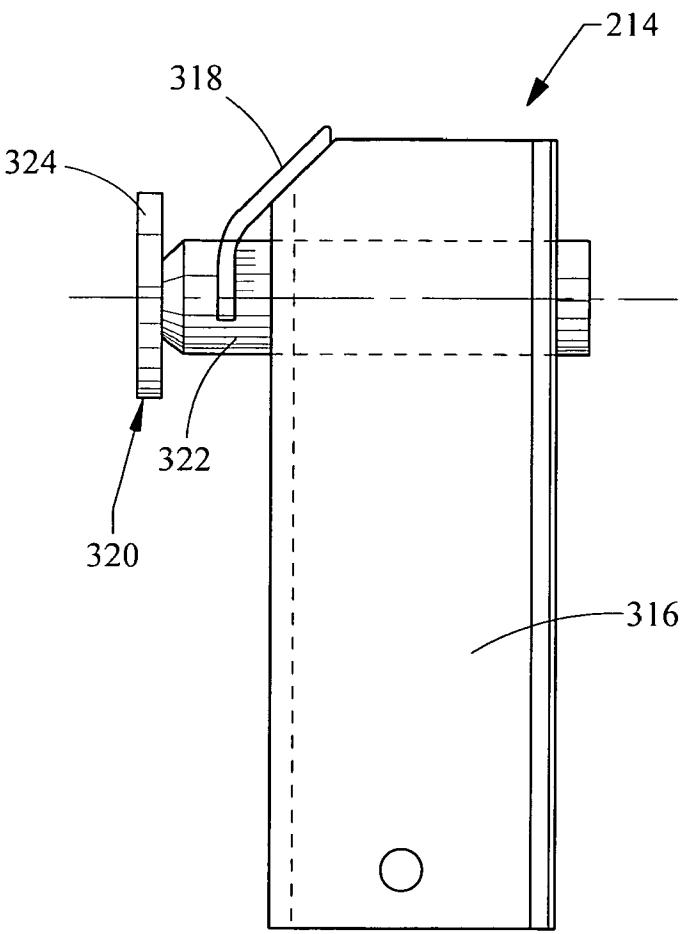
FIG. 14*b* is a side view of the side sill bracket of FIG. 14*a;*
Figure 14A:
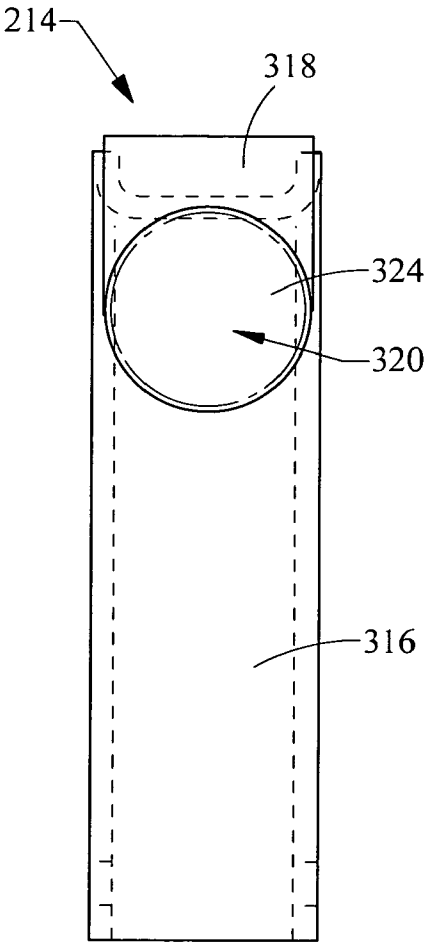
FIG. 14*a* is a front view of one embodiment of a side sill bracket.

One embodiment of a side sill bracket 214, as shown in FIGS. 14A-14B, includes a bearing block 316, a guide 318, and a pin assembly 320. The bearing block 316 is a vertically elongated member having a substantially rectangular cross-section. The cross-section of the bearing block 316 has substantially the same dimensions as the inner surface of a conventional side stake pocket 20 on a railcar 10. The bearing block 316 is adapted to be inserted into the side stake pocket 20, thereby forming a tight fit between the bearing block 316 and the side stake pocket 20 so as to provide a secure connection between the side brace 212 and the railcar 10. The bearing block 316 is formed such that the bearing block 316 extends upwardly from the side stake pocket 20 and above the top surface of the deck 22 of the railcar 10 when the bearing block 316 is disposed within the side stake pocket 20. The side sill bracket 214 is configured such that bearing block 316 can be secured to the side stake pocket 20 by way of a bolted connection, but the bearing block 316 need not be attached to the side stake pocket 20 by an attachment mechanism in order to provide a secure connection between the side sill bracket 214 and the side stake pocket 20.

The pin assembly 320 includes a pin 322 that extends through the thickness of the bearing block 316, as shown in FIGS. 14A-14B, and a head 324 that is connected to the pin 322 and has a radius that is greater than the radius of the pin 322 to which it is attached. The pin assembly 320 is adapted to be received by the keyhole aperture 224 of the lower support bracket 220 of a side brace 212, thereby providing an operative engagement between the side brace 212 and the railcar 10. The guide 318 is attached to bearing block 316 and the pin 322 of the pin assembly 320 to maintain the secured connection between the side brace 212 and the pin assembly 320.

Figure 15B:
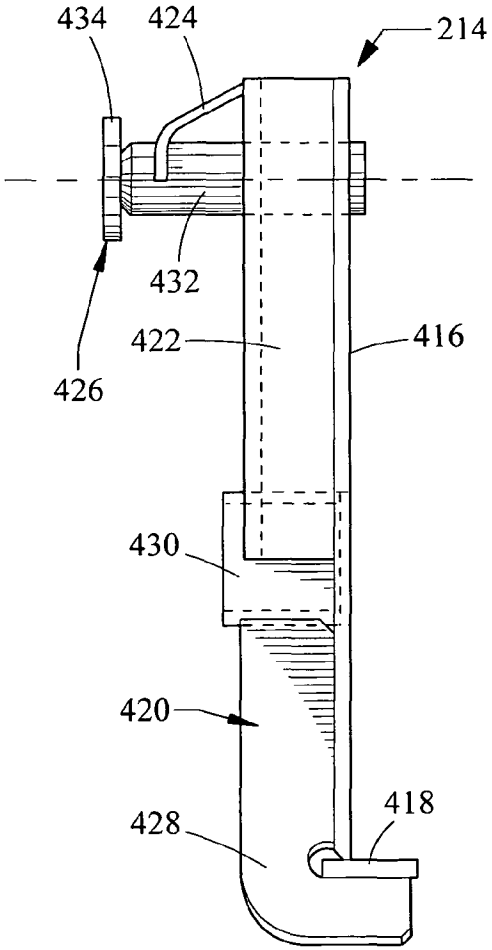
FIG. 15*b* is a side view of the side sill bracket of FIG. 15*a*.
Figure 15A:
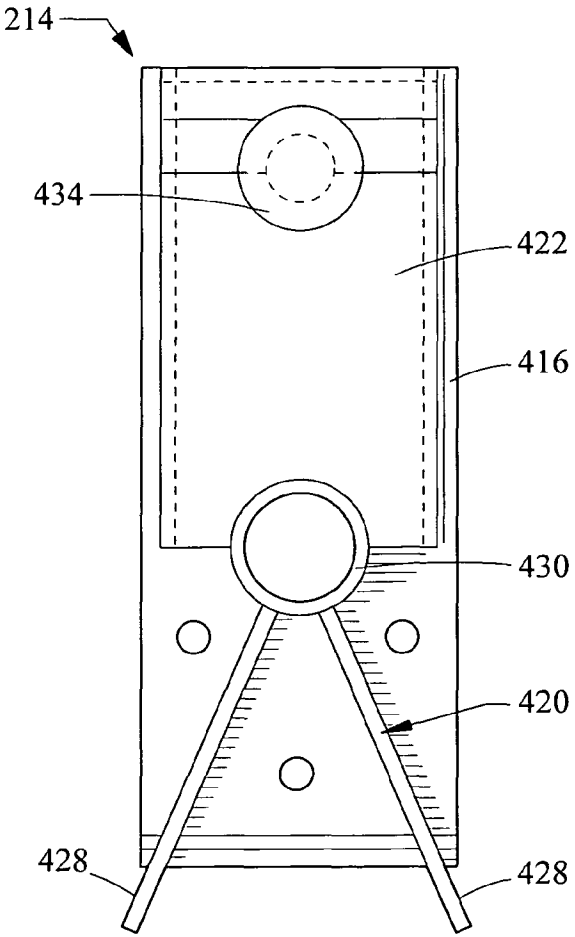
FIG. 15*a* is a front view of a second embodiment of a side sill bracket.

An alternative embodiment of a side sill bracket 214, as shown in FIGS. 15A-15B, includes a base plate 416, a spacer 418, a gusset 420, an upper support member 422, a guide 424, and a pin assembly 426. The base plate 416 is a substantially flat plate that is adapted to be disposed adjacent to the outwardly directed surface of a side sill 14 of the railcar 10 in a flush, abutting manner. The spacer 418 is attached to the bottom edge of the base plate 416 in a substantially normal direction relative to the base plate 416, wherein the spacer 418 is adapted to contact the downwardly directed surface of the side sill 14 of the railcar in a flush, abutting manner when the base plate 416 is attached to the side sill 14. The gusset 420 is formed as pair of curved legs 428 that extend downward from a circular member 430. The circular member 430 is operatively attached to the base plate 416, and each of the curved legs 428 extends downwardly from the circular member 430 at an angle relative to the other curved leg 428. The curved legs 428 extend in a downward manner from the circular member 430 adjacent to the outwardly-directed surface of the base plate 416. The curved legs 428 are substantially L-shaped members in which the lower portion of each curved leg 428 extends around the bottom edge of the base plate 416 and each curved leg 428 provides support to the surface of the spacer 418 opposite the surface abutting the side sill 14 of the railcar 10. The upper support member 422 is attached to the circular member 430 as well as the base plate 416 and extends upwardly from the circular member 430.

The pin assembly 426 includes a pin 432 that extends through the thickness of the upper support member 422, as shown in FIGS. 15A-15B, and a head 434 that is connected to the pin 432. The head 434 and has an outer radius that is greater than the outer radius of the pin 432 to which it is attached. The pin assembly 426 is adapted to be received by the keyhole aperture 224 of the lower support bracket 220 of the side brace 212, thereby providing an operative engagement between the side brace 212 and the railcar 10. The guide 424 is attached to upper support member 422 and the pin 432 of the pin assembly 426 to maintain the secured connection between the side brace 212 and the pin assembly 426.

When installing the removable bulkhead 12, 112 on a railcar 10, as shown in FIGS. 1 and 3, the support structure 26, 126 is lifted by way of the lifting lugs 29 to a position adjacent to the deck 22 of the railcar 10. When the support structure 26, 126 is positioned adjacent to the end stake pockets 18 of the railcar 10, the bottom connecting mechanisms 28 extending downwardly from the support structure 26, 126 are inserted into the end stake pockets 18. The bottom connecting mechanisms 28 do not form a snug fit with the end stake pockets 18, thereby providing enough space between each bottom connecting mechanism 28 and the corresponding end stake pocket 18 to allow the support structure 26, 126 to be tiltable in the for/aft direction relative to the longitudinal direction of the railcar 10 when aligning the side brace 212 of the stabilizing mechanism 210 with the side sill bracket 214.

Figure 16:
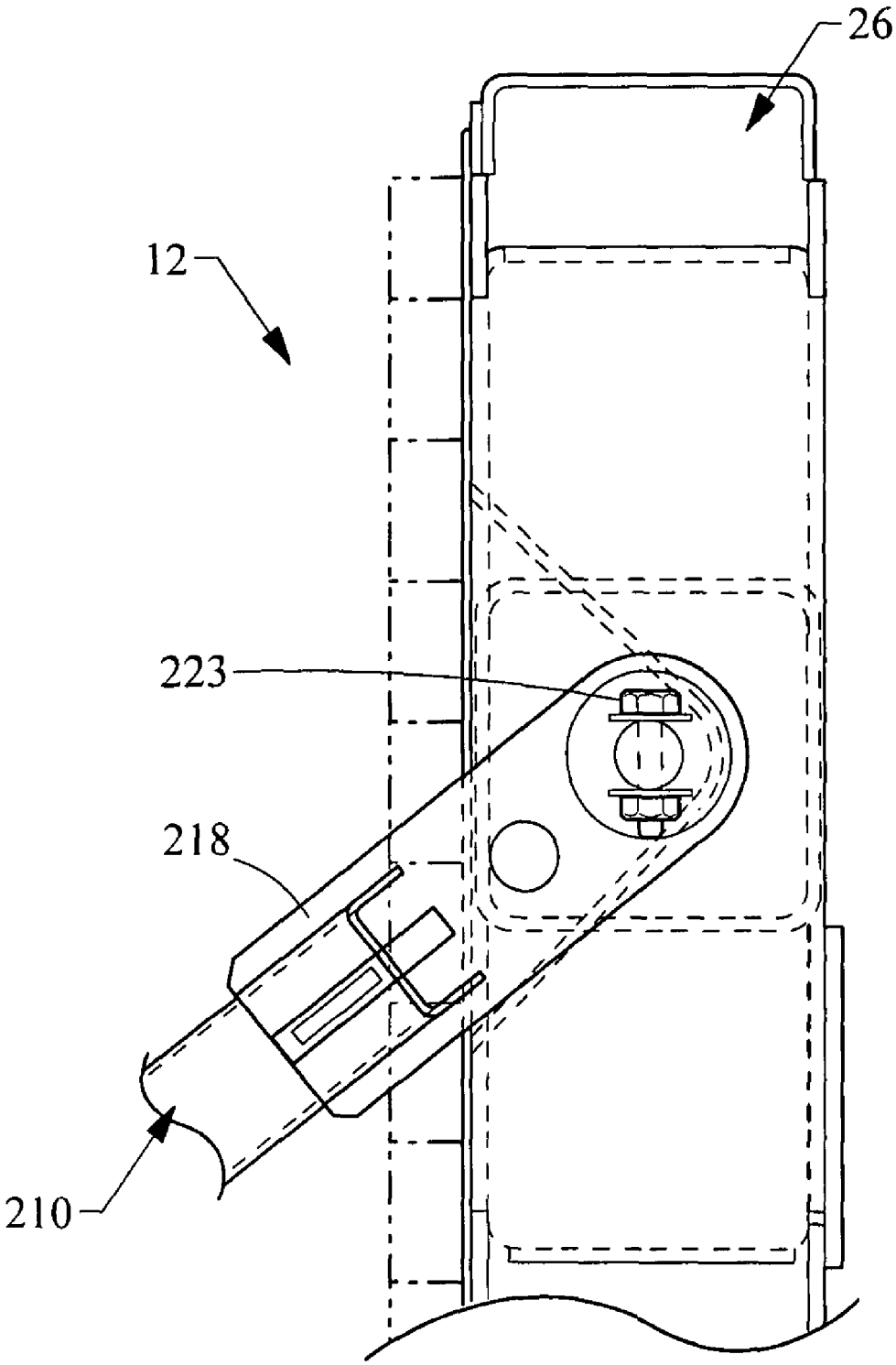
FIG. 16 is a magnified view of a stabilizing mechanism attached to a side connecting mechanism.

After the bottom connecting mechanisms 28 have been received within the end stake pockets 18, the upper support bracket 218 of the side brace 212 is operatively connected to the collar pin 94, 194 extending laterally from the side connecting mechanism 66, 166 in a rotatable manner, as shown in FIG. 16. The collar pin 94, 194 of the side connecting mechanism 66, 116 is inserted through the aperture 222 of the upper support bracket 218. As shown in FIG. 16, a bolt 223 is inserted through a hole passing through the end of the collar pin in order to secure the upper support bracket 218 to the side connecting mechanism 66, 166. Any other attachment means sufficient to maintain a rotatable connection between the upper support bracket 218 and the collar pin 94, 194 of the side connecting mechanism 66, 166 can be used.

The lower support bracket 220 is then operatively connected to the side sill bracket 214. The support structure 26, 126 can be rotated slightly in the fore-aft direction and the side brace 212 can be rotated relative to the side connecting mechanism 66, 166 in order to align the keyhole aperture 224 with the pin assembly 320, 426 of the side sill bracket 214. The keyhole aperture 224 receives the head 324, 434 of the pin 222, 432, thereby forming a secure connection between the removable bulkhead 12 and the railcar 10. One skilled in the art would understand that any other attachment means sufficient to secure the lower end of the support tube 216 to a side sill bracket 214 can be used.

When the stabilizing mechanism 210 is secured to both the railcar 10 as well as the support structure 26, 126, the removable bulkhead 12 is attached in a substantially rigid relationship relative to the railcar 10. The stabilizing mechanism 210 provides a load path between each side of the support structure 26, 126 and the railcar 10 in order to dissipate the stresses applied to the removable bulkhead 1 that may result from a shifting load. In addition, a horizontal brace 60 preferably extends between the opposing side connecting mechanisms 66 of the support structure 26 in order to form a continuous load path between the opposing side sill brackets 214 and the support structure 26.

While preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

The invention claimed is:

1. A removable bulkhead for a railcar, said railcar including a pair of spaced-apart side sills, and at least one end stake pocket, said removable bulkhead comprising:

a support structure removably attachable to said railcar, wherein said support structure includes at least one bottom connecting mechanism and said at least one bottom connecting mechanism is receivable in a corresponding end stake pocket of said railcar; and at least one stabilizing mechanism including:

at least one side sill bracket;

a side brace including a supporting tube, an upper support bracket attached to one end of said supporting tube, and a lower support bracket attached to an opposing end of said support tube, said lower support bracket including an aperture defined therein; and said lower support bracket being releasably attachable to said side sill bracket by a removable pin assembly.

2. The removable bulkhead of claim 1, wherein said support structure further includes at least two spaced-apart vertical braces.

3. The removable bulkhead of claim 2, wherein said support structure further includes at least one horizontal brace that extends between a pair of said spaced-apart vertical braces.

4. The removable bulkhead of claim 3, wherein said support structure further includes at least one side connecting mechanism, and each of said at least one side connecting mechanisms is attached to one of said at least two vertical braces.

5. The removable bulkhead of claim 4, wherein each of said at least one side connecting mechanisms is attached to one of said at least two vertical braces.

6. The removable bulkhead of claim 1, wherein said side sill bracket is operatively connected to said side sill of said railcar.

7. The removable bulkhead of claim 6, wherein said railcar further includes a side stake pocket attached to said side sill and side sill bracket is removably disposed within a corresponding side stake pocket.

8. The removable bulkhead of claim 1, wherein said upper support bracket is releasably attachable to one of said at least one side connecting mechanisms.

9. The removable bulkhead of claim 1, wherein said lower support bracket is removably attachable to said side sill bracket of said stabilizing mechanism.

10. The removable bulkhead of claim 1, wherein said stabilizing mechanism operatively connects said support structure to said railcar in a substantially rigid manner.

11. The removable bulkhead of claim 1, wherein said support structure further includes at least one side connecting mechanism.

12. The removable bulkhead of claim 11, wherein said at least one stabilizing mechanism is operatively connected to one of said at least one side connecting mechanisms as well as operatively connected to said side sill of said railcar.

13. The removable bulkhead of claim 11, wherein said railcar further includes at least one side stake pocket and said stabilizing mechanism is attached to one of said at least one side stake pockets.

14. The removable bulkhead of claim 11, wherein said stabilizing mechanism is attached to said side sill of said railcar in a substantially rigid manner.

15. The removable bulkhead of claim 1, wherein said removable pin assembly further comprises a removable pin and a side sill bracket.

16. The removable bulkhead of claim 15, wherein said side sill bracket is attached to a side sill of said rail car.

17. The removable bulkhead of claim 16, wherein said side sill bracket further comprises a bearing block adapted to be removably inserted into a side stake pocket of said railcar.

18. The removable bulkhead of claim 17, wherein said bearing block extends above a top surface of the deck of said railcar when it is inserted into said side stake pocket of said railcar.

19. The removable bulkhead of claim 18, wherein said bearing block further comprises an opening defined therein corresponding to said removable pin.

20. The removable bulkhead of claim 1, wherein said upper support bracket includes a plurality of apertures defined therein.

21. The removable bulkhead of claim 1, wherein said aperture is keyhole shaped.

22. A method for attaching a removable bulkhead to a railcar, said method comprising:

providing a railcar, wherein said railcar includes a pair of spaced-apart side sills, at least one side sill bracket, and at least one end stake pocket;

attaching said removable bulkhead to said railcar in a removable manner, wherein said removable bulkhead includes a support structure being receivable in one of said at least one end stake pocket;

attaching at least one stabilizing mechanism to said removable bulkhead, said stabilizing mechanism comprising a side brace including a supporting tube, an upper support bracket attached to one end of said supporting tube, and a lower support bracket including an aperture defined therein attached to an opposing end of said support tube;

attaching said lower support bracket to said side sill bracket through the use of a removable pin assembly.

23. The method of claim 22, wherein said support structure includes at least one bottom connecting mechanism that is receivable in a corresponding end stake pocket of said railcar.

24. The method of claim 22, wherein said railcar further includes at least one side stake pocket, and at least one stabilizing mechanism is operatively connected to a corresponding side stake pocket.

25. The method of claim 22, wherein said at least one stabilizing mechanism is connected to one of said side sills in a substantially rigid manner.

26. The method of claim 22, wherein said at least one stabilizing mechanism is removably connected to one of said side sills of said railcar.

* * * * *